United States Patent [19]

Feaser

[11] 4,077,624

[45] Mar. 7, 1978

[54] STRIKING DEVICE FOR TRAINING IN MARTIAL ARTS

[76] Inventor: David D. Feaser, Rte. 1, Box 69, Shepherdstown, W. Va. 25543

[21] Appl. No.: 733,468

[22] Filed: Oct. 18, 1976

[51] Int. Cl.[2] ..... A63B 69/22

[52] U.S. Cl. ..... 272/76; 46/47

[58] Field of Search ..... 272/76, 77, 78; 273/29 A, 95 A, 95 AA, 102 AP, 102.1 E, 26 R, 26 E, 26 EA; 46/47; 40/128

[56] References Cited

U.S. PATENT DOCUMENTS

| | | | |
|---|---|---|---|
| 1,132,101 | 3/1915 | Kleinschmidt | 272/76 |
| 1,267,678 | 5/1918 | McArdle et al. | 272/78 |
| 1,694,044 | 12/1928 | Thompson | 272/78 |

FOREIGN PATENT DOCUMENTS

| | | | |
|---|---|---|---|
| 516,092 | 12/1920 | France | 272/77 |
| 356,215 | 7/1922 | Germany | 272/77 |
| 705,216 | 4/1941 | Germany | 272/78 |
| 702,044 | 1/1941 | Germany | 272/78 |
| 46,210 | 3/1966 | Germany | 272/76 |

OTHER PUBLICATIONS

1916 Catalog of L. E. Knott Apparatus Co., Boston, Mass.

*Primary Examiner*—Richard C. Pinkham
*Assistant Examiner*—Arnold W. Kramer
*Attorney, Agent, or Firm*—Littlepage, Quaintance, Murphy, Richardson and Webner

[57] ABSTRACT

A striking device for use by a trainee in karate, boxing, etc., to simulate an opponent. Target elements are suspended by a cord from a fixed overhead position and pivoted rod-mounted response elements are balanced between the target elements. When the trainee strikes the target elements, the response elements move in an unpredictable manner to strike back at the trainee.

12 Claims, 8 Drawing Figures

STRIKING DEVICE FOR TRAINING IN MARTIAL ARTS

BACKGROUND OF THE INVENTION

1. Field of the Invention

The invention relates to a striking device for use in training in martial arts such as boxing and karate.

2. Description of the Prior Art

The object of any striking device for martial-arts training is to simulate a live opponent. In almost every instance, better training could be obtained with a live opponent except for a distressing tendency of live opponents to become temporarily or permanently inoperative every time a good blow is struck. Except for this problem, use of a live opponent has much to recommend it, including an ability to dodge blows and to strike back.

Punching bags have been used for many years as striking devices. They move to some extent, thereby dodging slightly, but they have virtually no ability to strike back. U.S. Pat. Nos. 3,250,533, 3,724,845 and 3,804,406 relate to striking devices which attempt to simulate a live opponent. Two of these require electric and/or pneumatic motors for operation. The third requires practice in a very awkward and unnatural manner.

SUMMARY OF THE INVENTION

The present invention provides a striking device which has the capability of striking a trainee back with a relatively unpredictable response. The striking device can simulate a live adversary and is designed to be fought instead of merely struck. The trainee develops skills of anticipation and response while practicing with the striking device. The striking device is also simple to construct and operates with no external power source.

The present invention provides a striking device which may be suspended from a fixed overhead position using one or more flexible suspension elements such as cords. One or more target elements, which may be positioned to simulate the head, stomach and knee areas of an opponent, are suspended along the cords. One or more rod elements, bearing at opposite ends response elements for simulating hands and elbows or feet and knees, are suspended and balanced on the cords between the target elements. When a target element is struck by a trainee, the blocking and striking elements carried on the rod elements react in an unpredictable fashion to simulate defensive and offensive actions by an opponent.

DESCRIPTION OF THE PREFERRED EMBODIMENTS

Figure 1:
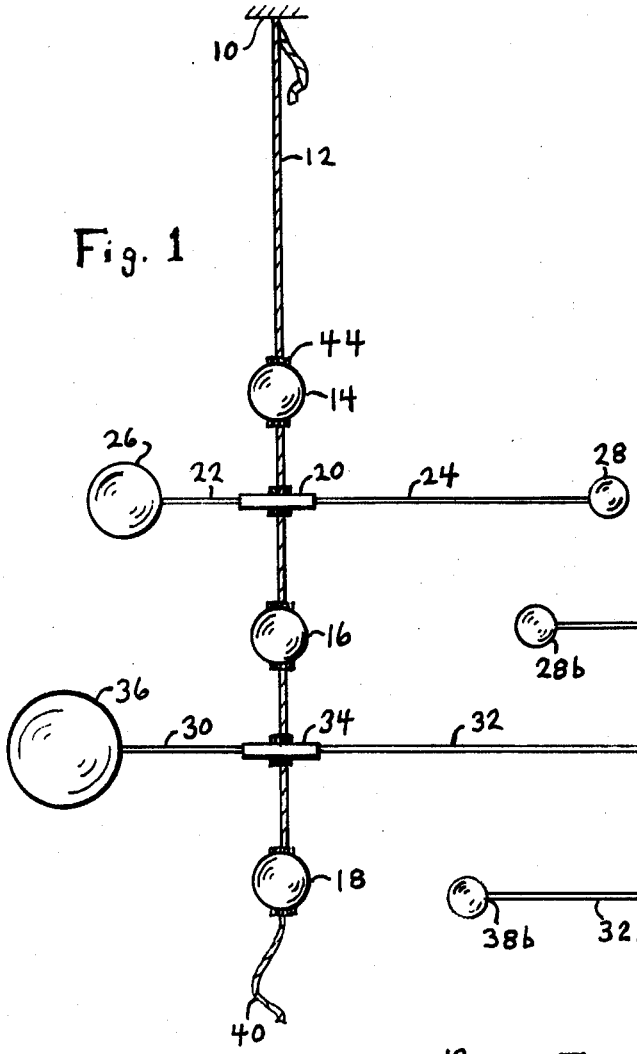
FIG. 1 is a side view of a simple striking device according to the invention, in which a single cord is used to support two balanced, singly mounted rod elements.

FIG. 1 illustrates a simple striking device according to the invention. To an overhead support 10, a flexible cord 12, which may be a length of nylon rope, is affixed. Three target elements 14, 16 and 18 are supported by the cord at different distances from the overhead support. The target elements are of a size and firmness to serve as targets. Although the target elements may be constructed in varying sizes and of different materials, suitable target elements for the first working model were constructed of rubber regulation-size softballs. Target elements 14, 16, and 18 are respectively intended to simulate the head, stomach and knee of an opponent.

Between the head and stomach target elements 14 and 16 is mounted a rod means intended to simulate the arm of an opponent. This rod means includes an axle element 20 centrally placed on bearings 44, which are affixed to the cord between elements 14 and 16, as well as, two rod segments 22 and 24 which extend into and are affixed to the axle element. The axle element 20 is arranged to be freely pivotable about bearings 44 and cord 12. Affixed to the outward ends of rod segments 22 and 24 are respectively response elements 26 and 28 intended to simulate the elbow and hand of an opponent. Between the stomach and knee target elements are mounted another rod means intended to simulate the leg of an opponent. Rod segments 30 and 32 are mounted on an axle 34 and carry response elements 36 and 38, which are intended to simulate the knee and foot of the opponent. The lower end of 40 of the cord may be affixed to a support or left to hang free as illustrated.

Figure 4:
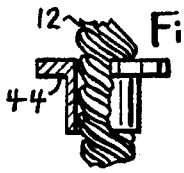
FIG. 4 is a partial cross-sectional view of a bearing affixed to the cord for mounting the axle element on the cord.
Figure 2:
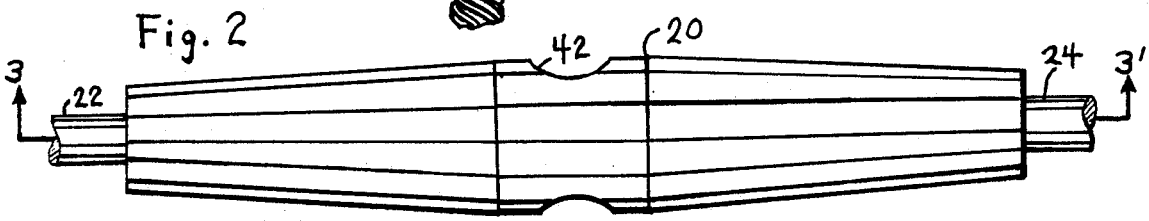
FIG. 2 is a side view of an axle element for mounting the rod elements on the cord.
Figure 3:
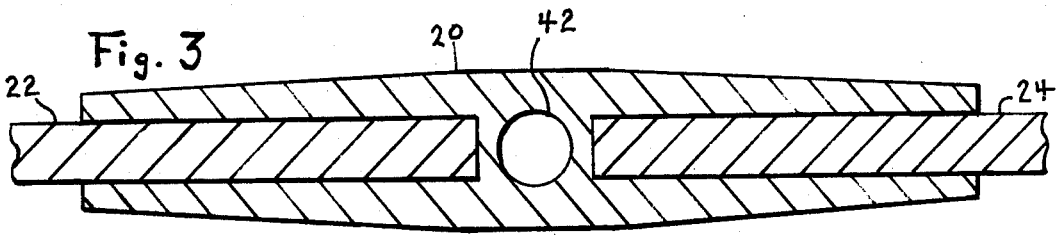
FIG. 3 is a cross-sectional view of the axle element taken on line 3—3' of FIG. 2.

FIGS. 2 and 3 are a side and a cross-sectional view of an axle element such as axle element 20 of FIG. 1. There are openings at each end of the axle element extending along the longitudinal axis of the axle element, into which openings the rod segments 22 and 24 are extended and therein affixed. A third opening 42 extends through the axle element on a transverse axis. The cord 12 passes through this third opening and is pivotally fixed in place therein through the use of a bearing 44 (FIG. 4), which extends partially into opening 42. Readily apparent variations of this axle element will be used in the devices of FIGS. 5, 6 and 7.

Figure 5:
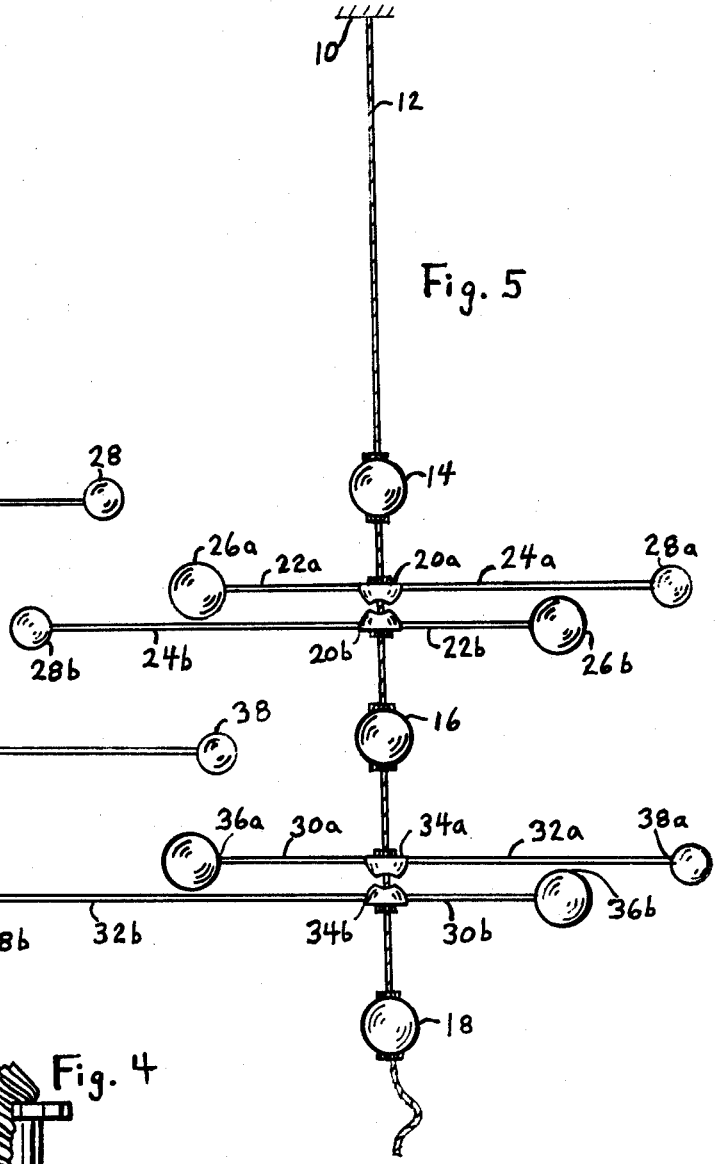
FIG. 5 is a side view of another striking device in which a single cord is used to support four balanced, doubly mounted rod elements.

FIG. 5 illustrates another striking device which is similar to that of FIG. 1 except that the rod means with response elements mounted thereon are mounted in pairs to simulate two arms and two legs of an opponent. Elements **26*a* and 26*b* correspond in function to element 26 of FIG. 1. Likewise, elements 20, 22, 24, 28, 30, 32, 34, 36 and 38 correspond to paired elements in FIG. 5**, the numerals denoting the paired elements including a suffix *a* or *b* to distinguish them from the unpaired elements.

Figures 6, 7, 8:
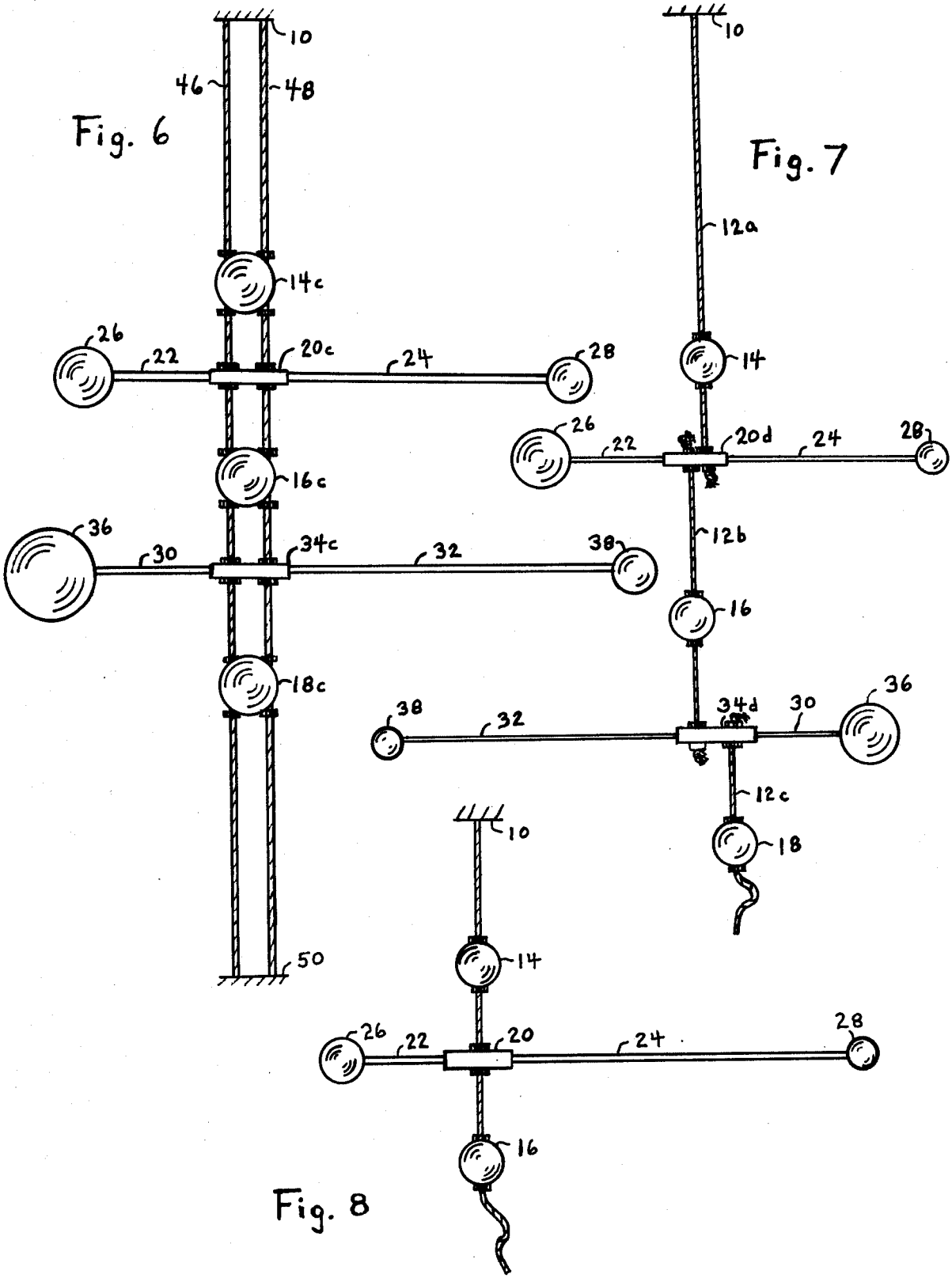
FIG. 6 is a side view of yet another striking device in which two parallel cords stretched between upper and lower supports are used to support two balanced, singly mounted rod elements.
FIG. 7 is a side view of yet another striking device in which a single cord, offset at points, is used to support two balanced, singly mounted rod elements.
FIG. 8 is a side view of a very simple form of striking device in which a single cord supports a single balanced rod element.

FIG. 6 illustrates another striking device which is similar to that of FIG. 1 except that two cords 46 and 48 are suspended between the overhead support 10 and a ground-level or floor-level support 50. While any of the illustrated embodiments can be used with a ground-level support, the embodiment of FIG. 6 is best adapted for use with such a lower support. The target elements 14*c*, 16*c* and 18*c* and axle elements 20*c* and 34*c* are similar to elements 14, 16, 18, 20 and 34 except that the cord passes through them in two places rather than one. The use of two cords and two supports gives the striking device of FIG. 6 greater torsional moment and quicker response than a typical device according to FIG. 1.

FIG. 7 illustrates another striking device which is similar to that of FIG. 1, except that various cord segments 12*a*, 12*b* and 12*c* in FIG. 7 replace what may be a single continuous cord 12 in FIG. 1. In addition, the axle elements 20*d* and 34*d* are each secured to two cord segments at different positions on the axle element, whereby the target elements are offset from one another. Thus, when the trainee strikes one of the target elements, his blows, being offset, cause a greater degree of movement of the rod means and response elements than would be caused by a non-offset blow. Of course an offset system with two cords could be used to further increase the responsiveness of the system.

FIG. 8 illustrates a basic system using only two target elements and one rod means. While the basic system of FIG. 8 is equivalent to the top part of the system of FIG. 1, similar basic systems can be constructed by omitting the elements below the stomach target element in the system of FIGS. 5, 6 and 7.

In use, the trainee strikes the appropriate target elements, blocks the elbow and knee response elements, and attempts to avoid being struck by the hand and foot response elements.

What is claimed is:

1. A striking device for use by a trainee in the martial arts comprising:

(A) cord means, (B) means for affixing the cord means near one end thereof to a support, (C) first and second target elements supported by the cord means at different distances from the support, the second target element being further from the support than the first target element, (D) first rod means centrally supported by the cord means between the first and second target elements, (E) response elements mounted on opposite ends of the first rod means, at unequal distances from the cord means, (F) a third target element supported by the cord means at a greater distance from the support than is the second target element, (G) a second rod means centrally supported by the cord means between the second and third target elements, and (H) additional response elements mounted on opposite ends of the second rod means at unequal distances from the cord means.

2. A striking device according to claim 1 wherein the cord means comprises cord aligned in a single, substantially straight, line as it passes through the three target elements and the two rod means.

3. A striking device according to claim 1 wherein the cord means comprises a plurality of substantially straight cord segments, at least one of the cord segments being axially offset from another cord segment where they are supportively connected to one of the rod means.

4. A striking device according to claim 1 wherein the cord means comprises cord aligned in two substantially straight and parallel lines as it passes through the three target elements and the two rod means.

5. A striking device according to claim 1 wherein each rod means comprises:

(A) an axle element having a longitudinal axis and a transverse axis, the axle element forming first and second hollow openings respectively extending from each end along the longitudinal axis and forming a third hollow opening extending through the axle element along the transverse axis, (B) first and second rod segments, each having one end thereof extending into and affixed in respectively the first and second opening and each having a second end for holding the response elements, and (C) bearing means affixed to the cord for holding the axle element pivotably in place as the cord passes through the third opening.

6. A striking device according to claim 1 wherein said response elements mounted on opposite ends of each of said rod means are of differing size.

7. A striking device according to claim 1 wherein said first and second rod means are pivotally mounted on said cord means.

8. A striking device according to claim 1 wherein there is further provided means for fixing the cord means near both ends thereof to suitable supports.

9. A striking device for use by a trainee in the martial arts comprising:

(A) cord means, (B) means for affixing the cord means near at least one end thereof to a support, (C) first and second generally spherical target elements supported by the cord means at different distances from the support, the second target element being further from the support than the first target element, (D) first rod means centrally supported by the cord means between the first and second target elements, (E) response elements mounted at opposite ends of the first rod means, (F) a third generally spherical target element supported by the cord means at a greater distance from the support than is the second target element, (G) a second rod means centrally supported by the cord means between the second and third target elements, (H) response elements mounted at opposite ends of the second rod means, (I) third rod means centrally supported by the cord means between the first and second target elements, (J) fourth rod means centrally supported by the cord means between the second and third target elements, and (K) additional response elements mounted at opposite ends of the third and fourth rod means, each of said target elements having a diameter generally coextensive with a longitudinal axis of the cord means.

10. A striking device for use by a trainee in the martial arts comprising:

(A) cord means, (B) means for affixing the cord means near at least one end thereof to a support, (C) first and second generally spherical target elements supported by the cord means at different distances from the support, the second target element being further from the support than the first target element, each of the target elements having a diameter generally coextensive with a longitudinal axis of the cord means, (D) first rod means centrally supported by the cord means between the first and second target elements, (E) response elements mounted at opposite ends of the first rod means, (F) a second rod means centrally supported by the cord means between the first and second target elements, and (G) additional response elements mounted at opposite ends of the second rod means.

11. A collection of parts adapted to be assembled into a striking device for use by a trainee in the martial arts, comprising:

(A) cord means, (B) means adapted to affix the cord means near at least one end thereof to a support, (C) first and second target elements adapted to be supported by support means on the cord means at different distances from the support, the second target element being adapted to be placed further from the support than the first target element, (D) first rod means adapted to be centrally supported by rod support means on the cord means between the first and second target elements, and (E) response elements adapted to be mounted on opposite ends of the first rod means at unequal distances from the cord means, (F) a third target element adapted to be supported by support means on the cord means at a greater distance from the support than is the second target element, (G) a second rod means adapted to be centrally supported by rod support means on the cord means between the second and third target elements, and (H) additional response elements adapted to be mounted on opposite ends of the second rod means at unequal distances from the cord means.

12. A collection of parts adapted to be assembled into a striking device according to claim 11 wherein the rod support means comprises:

(A) an axle element having a longitudinal axis and a transverse axis, the axle element forming first and second hollow openings respectively extending from each end along the longitudinal axis and forming a third hollow opening extending through the axle element along the transverse axis, (B) first and second rod segments, each having one end thereof adapted to extend into and be affixed in respectively the first and second opening and each having a second end adapted to hold the response elements, and (C) bearing means adapted to be affixed to the cord for holding the axle element in place as the cord passes through the third opening.

* * * * *